United States Patent [19]

Hanyu et al.

[11] 4,331,090

[45] May 25, 1982

[54] BOBBIN THREAD TENSIONING DEVICE FOR A SEWING MACHINE

[75] Inventors: Susumu Hanyu; Yoshinobu Tonomura; Hideaki Takenoya; Masanori Hara, all of Hachioji, Japan

[73] Assignee: Janome Sewing Machine Co., Ltd., Tokyo, Japan

[21] Appl. No.: 152,577

[22] Filed: May 23, 1980

[30] Foreign Application Priority Data

May 23, 1979 [JP] Japan ..... 54/62584

[51] Int. Cl.[3] ..... D05B 47/04

[52] U.S. Cl. ..... 112/229; 112/278

[58] Field of Search ..... 112/229, 278, 254, 228, 112/273

[56] References Cited

U.S. PATENT DOCUMENTS 2,543,475 2/1951 Slodysko ..... 112/229

4,166,423 9/1979 Brienza et al. ..... 112/278 X 4,193,363 3/1980 Beckerman et al. ..... 112/278

*Primary Examiner*—Peter P. Nerbun

*Attorney, Agent, or Firm*—Michael J. Striker

[57] ABSTRACT

A device for automatically adjusting the tension of a lower thread, which comprises a lower thread bobbin arranged on a bottom plate of a bobbin carrier turnably carrying the bobbin, a loop taker mounted on a magnetic shaft, and an energizing coil arranged around the magnetic shaft and providing together with said bottom plate and magnetic shaft a path of magnetic flux. The device is further provided with a detector detecting the consumed amount of the bobbin thread and a control circuit for energizing the coil when the lower thread is wound to the maximum capacity of the bobbin, interrupting the light of the detector. The detector operates the control circuit to decrease the amount of electric current applied to the energizing coil so as to set the lower thread tension back to its initial predetermined value.

6 Claims, 6 Drawing Figures

BOBBIN THREAD TENSIONING DEVICE FOR A SEWING MACHINE

BACKGROUND OF THE INVENTION

The invention relates to a sewing machine, and more particularly to a bobbin thread tensioning device for a sewing machine having a loop taker, and a bobbin carrier for a lower thread.

According to the prior art, the adjustment of the bobbin thread tension has been made by fastening or unfastening a screw which secures a thread tensioning leaf spring to a bobbin or a bobbin carrier. Such an operation is possible only when the sewing machine is stopped to open the needle plate and take out the bobbin or bobbin carrier carrying the bobbin thread tensioning leaf spring. Such an adjustment is burdensome, and moreover it is unefficient to interrupt the machine running operation. Further in a case that the rotation torque of the bobbin is adjusted for adjusting the tension of the lower thread, the difference in the tension is brought about, since the difference in the thread remaining amount is due to difference in radius of the rotation of supplying the thread though the rotation torque is made constant.

SUMMARY OF THE INVENTION

It is an object of the invention to provide a bobbin thread tensioning device for a sewing machine, in which the bobbin thread tension is controlled by an electromagnetic force which is adjustable by means of a control circuit. For attaining this object, the device of the invention comprises a cup-shaped loop taker with a magnetic central shaft connected to a lower shaft of the sewing machine, a bobbin carrier having a central bore provided with a magnetic bottom plate and supported within the loop taker, a magnetic bobbin placed within the central bore of the bobbin carrier, an energizing coil mounted around the magnetic central shaft of the loop taker, a device for detecting of the amount of a remaining lower thread, and a control circuit for manually adjusting the amount of the electric current flowing through the energizing coil and decreasing the electric current when the detecting device detects the determined amount of the thread. The device adjusts the tension of the lower thread by the electric control so that variation of the tension due to the remaining amount of thread on the bobbin is reduced as much as possible.

The device according to the present invention adjusts the rotation torque of the bobbin through the electromagnetic force which is designated from the outside operation, in order to give the tension to the lower thread, and detects the remaining amount of the lower thread for compensating the variation of the tension owing to the difference in the remaining amount.

DETAILED DESCRIPTION OF THE INVENTION

Figure 1:
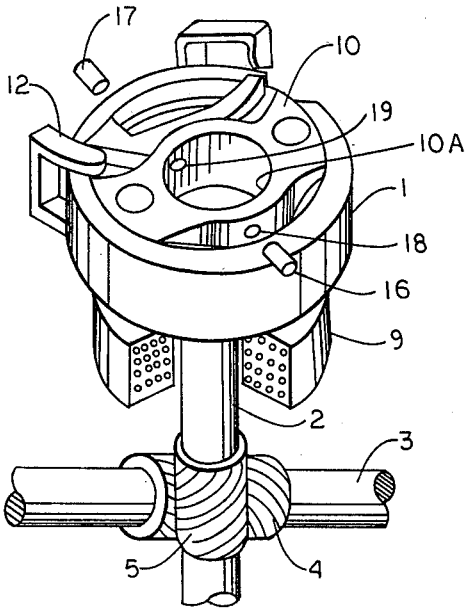
FIG. 1 is a perspective view of a device provided with the invention and shown partially in section.
Figure 2:
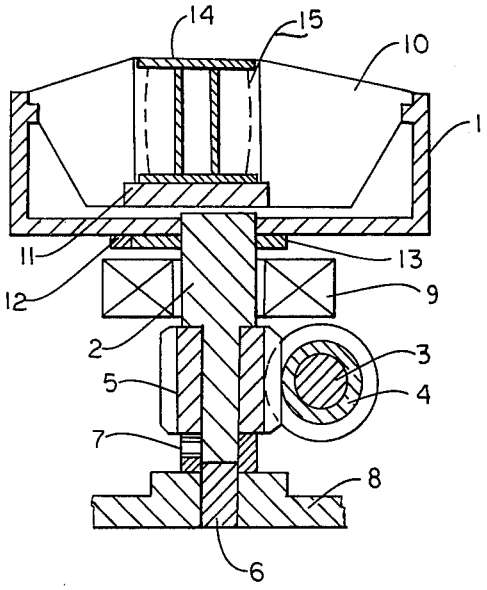
FIG. 2 is a front elevational view of the invention shown in a vertical section.

In reference to FIGS. 1 and 2, a cup shaped loop taker 1 has a magnetic central shaft 2. The magnetic central shaft 2 is secured to the lower part of the loop-taker and is provided with a gear 5 which is in mesh with a gear 4 mounted on a lower shaft 3 of a sewing machine, so that the loop taker may be rotated in time relation with the lower shaft. A non-magnetic auxiliary shaft 6 is axially secured to the lower end of the magnetic shaft 2 by means of a screw 7 and is fittedly received by a part 8 of the machine housing (not shown). An energizing coil 9 is provided around the magnetic shaft 2, the energizing current of which is controlled by a control circuit which will be described hereinafter. A bobbin carrier 10 with an axial bore 10A is supported within and by the loop taker 1 as shown, and is held by a swingable holding device having a pair of arms 12 for alternately engaging the bobbin carrier 10 during the rotation of the loop taker 1. The bobbin carrier 10 is made of a synthetic resin, but the bottom of the central bore 10A is a magnetic metal 11. The bobbin carrier 10 is supported within the cup shaped loop taker 1 in such a manner that there is a slight space between the bottom of the bobbin carrier and the bottom of the loop taker as shown. The bobbin carrier 10 is prevented from rotation by two-arm swingable device 12 if the loop taker 1 is rotated. A non-magnetic eccentric cam 13 is coaxially secured to the magnetic shaft 2 to swing the swingable holding device 12. A magnetic bobbin 14 with a thread 15 wound therearound is placed within the central bore 10A of the bobbin carrier 10. The bobbin 14 is rotated as the thread 15 is drawn out. The magnetic shaft 2, the magnetic bottom 11 of the bobbin carrier 10 and the magnetic bobbin 14 form a magnetic path through the center of the energizing coil 9 and between the upper end of the bobbin 14 and the lower end of the shaft 2. The amount of the magnetic flux of the magnetic path is, therefore, determined by the amount of the energizing electric current of the energizing coil 9. Accordingly, the attracting force between the bottom plate 11 of the bobbin carrier 10 and the bobbin 14 may be varied by the amount of the magnetic flux. The numeral 16 is a luminous diode provided to the machine body and the numeral 17 is a phototransistor in opposition thereto, between which the bobbin carrier 10 is formed with penetrating holes 18, 19 on a line connecting the both for passing the light from the luminous diode 16 to the phototransistor 17.

Figure 3:
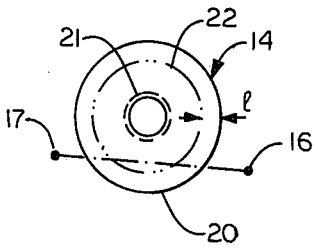
FIGS. 3 and 6 are diagrammatic views of a bobbin of the lower thread and a photodetection.

The light path therebetween is, as shown with a chain line in FIG. 3, positioned almost at a center between an outer circumference 20 of the bobbin 14 and a circumference 21 of the bobbin shaft, and when the remaining amount of the lower thread is, as shown with a two-dotted line 22, more than a center position, the thread interrupts the light to largely actuate the phototransistor 17, and when it is lesser the phototransistor receives the light.

Figure 4:
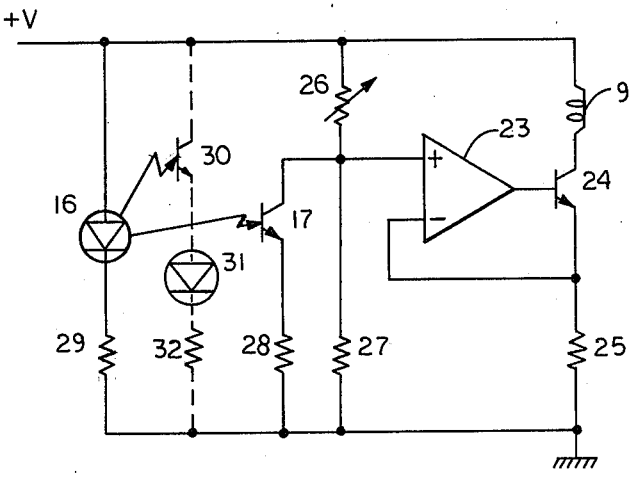
FIG. 4 is a control circuit diagram.

FIG. 4 shows a control circuit of the energizing coil 9, in which an operation amplifier 23 has the output terminal connected to the base of a transistor 24. The transistor 24 has a collector connected to one end of the energizing coil 9, the other end of which is connected to the power source +V. The transistor 24 has an emitter grounded through a resistor 25 and also connected to an inverting input terminal (−) of the operation amplifier 23. The operation amplifier 23 has a non-inverting input terminal receiving the power source +V divided by a resistor 27 and a variable resistor 26 for adjusting the thread tension. The phototransistor 17 in parallel with the resistor 27 is connected by its emitter to a resistor 28, and works when it receives the light of the luminous diode 16 at its base, and the resistor 28 constitutes a parallel circuit with the resistor 27. The numeral 29 is a resistor of limiting the electric current of the luminous diode 16.

With such a structure of the invention, if the lower thread is full on the outer circumference 20 of the bobbin 14, the phototransistor 17 is prevented from the light and inoperative, and therefore a non-inverting input terminal (+) of the operation amplifier 23 receives the electric potential divided by the variable resistor 26 and the resistor 27, and for example, decreasing of the value of the variable resistor 26 heightens said electric potential and the electric potential of the output of the operation amplifier 23 so that the electric current of the energizing coil 9 increases. Therefore, when the electric current flowing through the resistor 25 is increased, the input potential at the inverting input terminal (−) of the operation amplifier 23 is heightened and a feedback effect is produced. The increased amount of the electric current flowing through the energizing coil 9 increases the amount of the magnetic flux flowing through the magnetic path of the shaft 2, the bottom plate 11 of the bobbin carrier 10 and the bobbin 14. Therefore, the attracting force is increased between the bobbin plate 11 of the bobbin carrier 10 and the bobbin 14, and accordingly the friction force is so much provided between the two elements 11 and 14, if the thread 15 is drawn out from the bobbin 14. As a result, the drawn out thread is tightened.

Figure 5:
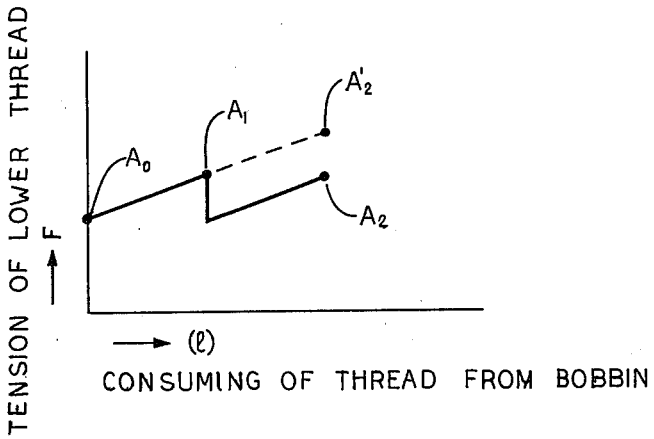
FIG. 5 is a diagrammatic view showing a relationship between the amount of consuming the lower thread from the bobbin and the tension of the thread.

In reference to FIG. 5, when the thread on the bobbin 14 is consumed from a starting point A0 at the same level as the outer circumference 20, that is, when a space l in FIG. 3 becomes larger, the tension F of the lower thread becomes higher as shown in FIG. 5. When the two-dotted line 22 indicating the amount of the remaining thread reaches the line between the diode 16 and phototransistor 17, the phototransistor 17 receives the light and works to make the resistor 28 operative. This is a point A1 in FIG. 5 where the electric potential of the non-inverted input terminal (+) of the operation amplifier 23 decreases and the output potential of the operation amplifier decreases, and accordingly, the thread tension decreases. Subsequently, as the consumption of the thread increases, the tension of the lower thread increases, and just before no remaining of the thread the tension becomes the same as the point A1 as seen at a point A2. A dotted line in FIG. 5 shows the tension of the lower thread in the prior art where the phototransistor 17 is not provided, and as is seen the tension increases after the point A1 as A1–A2' with unfavourable result.

Figure 6:
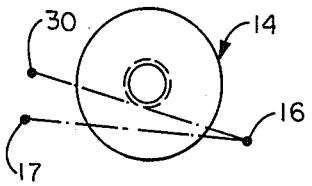

In reference to FIG. 6, a phototransistor 30 (also shown in FIG. 4) is provided together with the phototransistor 17 and a further penetrating hole (not shown) is formed as the hole 19 in FIG. 1 to form a path in this case at a position opposite to a position just before receiving the light in order to detect that the thread becomes near zero. As shown in FIG. 4, at the operation of the phototransistor 30, a luminous diode 31 is made conductive via a resistor 32 and a luminous diode 31 indicates that the remaining amount of the thread is near to zero and it be supplied as shown by the dotted line in FIG. 5.

As having mentioned above, the invention employs the energizing coil for adjusting the thread tension in order to electrically control the rotation friction while confirming the tension as holding the relative mechanisms with the lower thread and during the stitching operation, and the variation in the tension due to the consumption of the lower thread is automatically compensated to maintain the suited thread tension.

We claim:

1. A bobbin thread tensioning device for a sewing machine having a lower shaft, comprising a cup-shaped loop taker; a bobbin carrier accommodated within said loop taker and formed with a central bore; a magnetic bobbin for carrying a lower thread, said bobbin being received within said central bore and adapted to be rotated as the lower thread is drawn out; a magnetic central shaft rigidly secured to said loop taker and operatively connected to the lower shaft of the sewing machine for rotation therewith, said bobbin carrier being provided with a magnetic plate positioned in the vicinity with said magnetic shaft; detecting means for detecting the amount of the lower thread remaining on the bobbin during the operation of the sewing machine; and bobbin thread tension adjusting means including an energizing coil surrounding said magnetic shaft so that said magnetic bobbin, said magnetic plate and said magnetic shaft form a magnetic path passing through the center of said energizing coil, and a control circuit electrically connected to said energizing coil, said control circuit being operatively connected to said detecting means for adjusting the amount of the electric current flowing through said energizing coil and thus changing the electromagnetic force in said magnetic path and affecting the friction force between said magnetic plate and said bobbin thereby tightening the lower thread in response to the predetermined amount of the remaining lower thread detected by said detecting means.

2. The device of claim 1, wherein said detecting means include a luminous diode and a phototransistor, said diode and said phototransistor being positioned at the opposite sides of said bobbin carrier.

3. The device of claim 2, wherein said bobbin carrier is formed with holes provided against said diode and said phototransistor respectively to provide a passage for the light passing from said diode to said phototransistor.

4. The device of claim 3, wherein said bobbin carrier is made of a synthetic resin, said magnetic plate being located at the bottom of said bobbin carrier.

5. The device of claim 4, wherein said bobbin carrier is accommodated within said loop taker with a slight clearance therebetween.

6. The device of claim 5, further comprising means for preventing said bobbin carrier from rotation including two swingable arms adapted to hold said bobbin carrier when said magnetic central shaft with said loop taker are rotated.

* * * * *